US009945223B2

(12) United States Patent
Li et al.

(10) Patent No.: US 9,945,223 B2
(45) Date of Patent: Apr. 17, 2018

(54) FATIGUE CALCULATOR GENERATION SYSTEM

(71) Applicant: Schlumberger Technology Corporation, Sugar land, TX (US)

(72) Inventors: Ke Ken Li, Missouri City, TX (US); Edward George Parkin, Cheltenham (GB); Rakesh Singh, Maharastra (IN); Anthony Louis William Collins, Houston, TX (US); Keith Moriarty, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 287 days.

(21) Appl. No.: 14/826,069

(22) Filed: Aug. 13, 2015

(65) Prior Publication Data

US 2016/0047223 A1 Feb. 18, 2016

Related U.S. Application Data

(60) Provisional application No. 62/037,533, filed on Aug. 14, 2014.

(51) Int. Cl.
*E21B 47/00* (2012.01)

(52) U.S. Cl.
CPC ..... *E21B 47/0006* (2013.01)

(58) Field of Classification Search
CPC ..... E21B 47/0006
See application file for complete search history.

(56) References Cited

U.S. PATENT DOCUMENTS 8,504,308 B2 8/2013 Li et al.
2004/0221985 A1* 11/2004 Hill ..... E21B 44/00 166/250.01
2007/0200345 A1 8/2007 Toscano et al.
2008/0319720 A1* 12/2008 Ellis ..... F16L 15/004 703/2
2009/0158591 A1 6/2009 Huff et al.
2011/0178730 A1 7/2011 Mangal et al.
(Continued)

OTHER PUBLICATIONS

Majumdar, Barun Kanti; "Drill Pipe Fatigue Analysis in Offshore Application", Dec. 1986.*

(Continued)

*Primary Examiner* — Joseph C Nicely

(57) ABSTRACT

Aspects of the disclosure can relate to a system for tracking fatigue damage experienced by a tool in real-time. The system can include a processor operably coupled to a memory and operable to execute one or more modules to generate master curve fitting coefficients for a connection type associated with a tool component (e.g., a component of a bottom hole assembly). The master curve fitting coefficients can be for a threaded connection master curve, a port hole master curve, and so forth. The processor can also be operable to execute the one or more modules to generate a fatigue calculator for the tool component. The system may receive a real-time trajectory for the tool, determine a curvature from the trajectory of the tool, determine a bending moment based upon the curvature, and determine fatigue damage for the tool component based upon the bending moment using the fatigue calculator.

20 Claims, 9 Drawing Sheets

(56) References Cited

U.S. PATENT DOCUMENTS

| | | | | |
|---|---|---|---|---|
| 2011/0186353 | A1* | 8/2011 | Turner | G05B 13/048 175/40 |
| 2012/0016589 | A1* | 1/2012 | Li | E21B 47/0006 702/9 |
| 2015/0075274 | A1* | 3/2015 | Kpetehoto | E21B 47/0006 73/152.48 |
| 2016/0076368 | A1* | 3/2016 | Forstner | E21B 44/00 175/57 |
| 2017/0067337 | A1* | 3/2017 | Havens | E21B 47/16 |

OTHER PUBLICATIONS

Vaisberg et al, "Fatigue of Drillstring: State of the Art" Oil & Gas Science and Technology, vol. 57, 2002, No. 1, pp. 7-37.*

International Search Report and Written Opinion issued in related International Application No. PCT/US2015/045185 dated Nov. 4, 2015 (7 pages).

* cited by examiner

FATIGUE CALCULATOR GENERATION SYSTEM

CROSS REFERENCE TO RELATED APPLICATIONS

This is a non-provisional patent application of U.S. Provisional Patent Application Ser. No. 62/037,533 to Ke Ken Li, et al, filed on Aug. 14, 2014, and entitled "Fatigue Calculator Generation," which is hereby incorporated in its entirety for all intents and purposes by this reference.

BACKGROUND

Oil wells are created by drilling a hole into the earth using a drilling rig that rotates a drill string (e.g., drill pipe) having a drill bit attached thereto. The drill bit, aided by the weight of pipes (e.g., drill collars) cuts into rock within the earth. Drilling fluid (e.g., mud) is pumped into the drill pipe and exits at the drill bit. The drilling fluid may be used to cool the bit, lift rock cuttings to the surface, at least partially prevent destabilization of the rock in the wellbore, and/or at least partially overcome the pressure of fluids inside the rock so that the fluids do not enter the wellbore.

SUMMARY

Aspects of the disclosure can relate to a system for tracking fatigue experienced by a tool in real-time. The system can include a controller to receive a real-time trajectory for the tool from a user interface and/or a sensor coupled with the tool, and a processor operably coupled to a memory and operable to execute one or more modules to generate master curve fitting coefficients (e.g., a set of master curve fitting coefficients) for a connection type associated with a tool component of the tool (e.g., a component of a bottom hole assembly). The master curve fitting coefficients can be for a threaded connection master curve, a port hole master curve, and so forth. The processor can also be operable to execute the one or more modules to generate a fatigue calculator for the tool component, determine a curvature from the trajectory of the tool, determine a bending moment based upon the curvature, and determine fatigue damage for the tool component based upon the bending moment using the fatigue calculator.

Other aspects of the disclosure can relate to a method for tracking fatigue experienced by a tool in real-time. The method can include generating master curve fitting coefficients for a connection type associated with a tool component of the tool, receiving a real-time trajectory for the tool, determining a curvature from the trajectory of the tool, determining a bending moment based upon the curvature, and determining fatigue damage for the tool component based upon the bending moment using the master curve fitting coefficients.

Also, aspects of the disclosure can relate to a system for tracking fatigue experienced by a tool. The system can include a controller to receive a trajectory for the tool, and a processor operably coupled to a memory and operable to execute one or more modules to generate master curve fitting coefficients (e.g., a set of master curve fitting coefficients) for a connection type associated with a tool component of the tool (e.g., a component of a bottom hole assembly). The master curve fitting coefficients can be for a threaded connection master curve, a port hole master curve, and so forth. The processor can also be operable to execute the one or more modules to determine a curvature from the trajectory of the tool, determine a bending moment based upon the curvature, and determine fatigue damage for the tool component based upon the bending moment using the master curve fitting coefficients.

This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Embodiments of fatigue calculator generation system are described with reference to the following figures.

DETAILED DESCRIPTION

Figure 1:
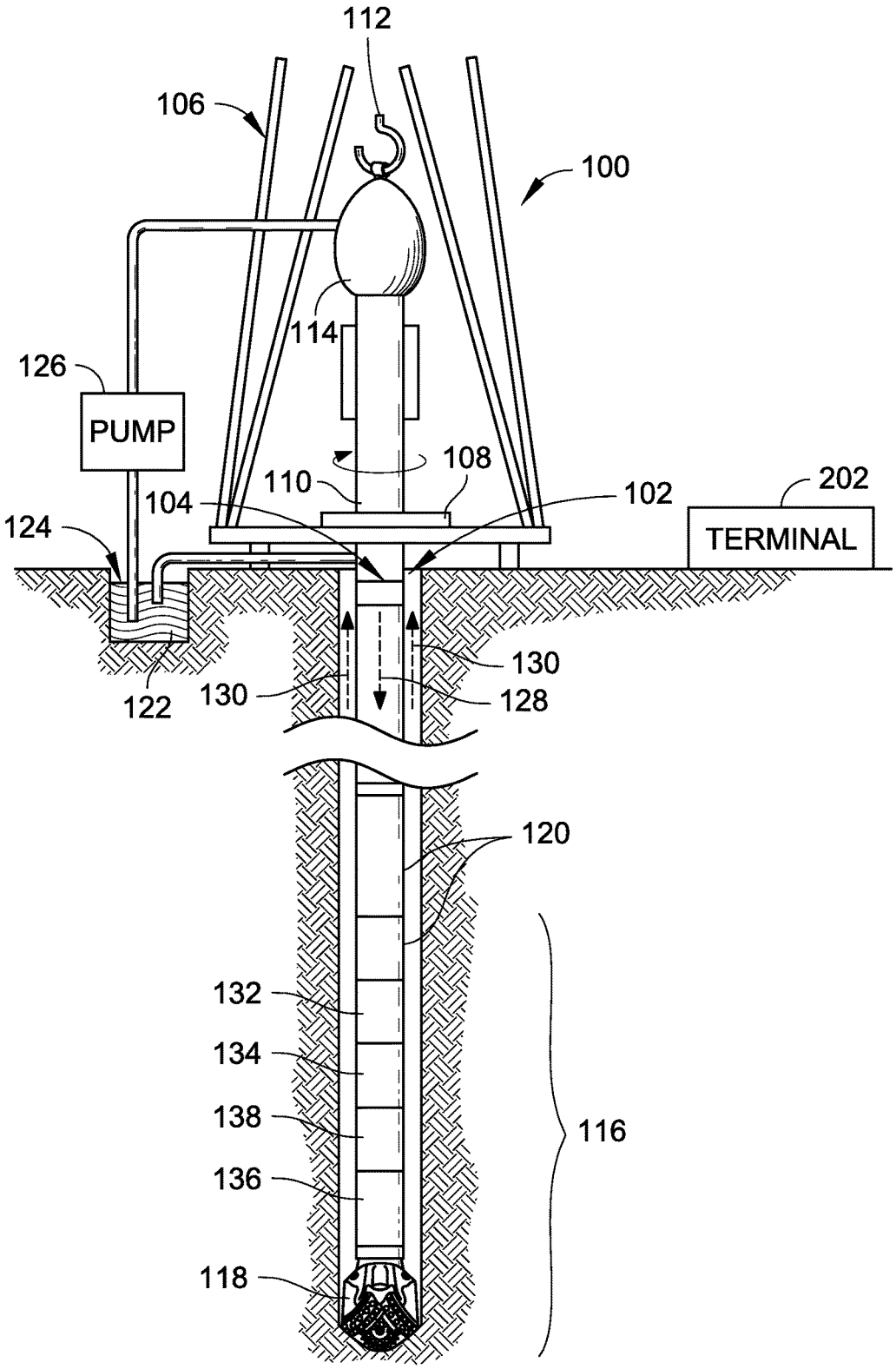
FIG. 1 illustrates an example system in which embodiments of a fatigue calculator generation system can be implemented.

A drill string can be used to drill a hole in a formation to reach a targeted hydrocarbon reservoir. In some embodiments, a drill string includes a drill bit, a rotary steerable system, one or more measurement while drilling (MWD) tools, one or more logging while drilling (LWD) tools, drill pipes, heavy-weight drill pipes, and so forth. The drill string can also include string stabilizers, jars, reamers, under reamers, crossovers, miscellaneous subs, and so on. These components can be connected through rotary shouldered threaded connections. The lowest section of the drill string can be referred to as a bottom hole assembly (BHA). The BHA can be placed above (e.g., directly above) the drill bit and below the drill pipes. Each tool can be mechanically shielded by a drill collar, which may or may not contain sensors and/or electronics inside for logging and/or measurement. One or more port holes can be used in a drill collar for various purposes. Drill collars can also provide weight on the drill bit to facilitate better control and/or penetration.

Fatigue damage can account for a substantial portion of drill collar failures. For example, drilling can involve rotation of a BHA through a planned well trajectory, which may be curved. In these configurations, the components of the BHA undergo rotating-bending in different degrees. The alternating stresses induced on the equipment can lead to accumulation of fatigue damage in the BHA components, especially in equipment features that include stress risers, such as collar portholes, fillet radii at diameter changes, threaded connections, and so on. In an example, when the alternating stress at a collar feature is below a certain threshold, which can be referred to as the fatigue strength of the collar material, the accumulation of fatigue damage may be comparatively slow, and the collar feature may be used for a comparatively long time without experiencing fatigue induced failure.

As alternating stress increases, however, the fatigue life of the collar material may decrease (e.g., exponentially). For instance, in a case where a highly curved (high dog-leg) well is being drilled, fatigue damage can accumulate comparatively quickly at fatigue-sensitive features. Thus, the life of the most fatigue-sensitive feature on a BHA may not be sufficiently long to complete a planned job, especially with accumulated fatigue damage from prior jobs. As described herein, damage to the BHA can be monitored, so that a driller can remove the drill string (e.g., after a predetermined threshold of fatigue damage has been reached). As noted above, fatigue damage is a cumulative process, and previous load history has been recorded by the material. Hence, the usage of each BHA component can be tracked to determine total cumulative fatigue damage.

In some embodiments, a multi-scale fatigue analysis methodology can be used to predict the fatigue damage of each fatigue-sensitive feature on a given BHA. This finite element based methodology can be used to facilitate collar and/or BHA configuration designs to increase the fatigue life of a BHA, as well as to develop fatigue calculators for a specified BHA, perform real-time tracking of fatigue damage to avoid twist-offs (e.g., using a fatigue calculator), conduct postmortem analysis of failed components to propose preventive measures so that future failures can be reduced or eliminated, and so forth. However, when multiple collar and/or BHA configurations are considered, these techniques can become time and/or labor intensive. For example, developing a fatigue calculator can be labor intensive. When a new BHA configuration is proposed, a beam-type finite element model may be constructed for the BHA, and a Dog-Leg Severity (DLS) versus bending moment relation can be determined.

Finite Element Analysis (FEA) can be used to compute the stress and strain states at fatigue-sensitive features, such as threaded connections, port holes, fillet radii at diameter changes, and so on, which are subjected to bending and other associated loads. The established bending moment versus fatigue life relation can then be used with the DLS versus bending moment relation to attain a DLS versus fatigue life relation, which can then be used for a fatigue calculator that tracks fatigue damage of BHA components (e.g., in a real-time manner). Further, fatigue calculators may be developed by an expert group (e.g., because multiple FEA simulations may be used to generate a fatigue calculator for a given BHA, which implies advanced knowledge and experience of FEA and solid modeling). Relying on FEA experts to generate a fatigue calculator when there is a change to a BHA configuration can be inconvenient and/or inefficient. Further, storing a number of different generated fatigue calculators and using an appropriate one for a given BHA may be a challenging and/or error-prone process.

Referring generally to FIGS. 1 through 10, systems and methods are described that can determine fatigue for a tool, such as a bottom hole assembly (BHA) used in drilling an oil and/or gas well. As described herein, the systems and methods can be used to automatically generate one or more fatigue calculators for a specified BHA configuration. A fatigue calculator can then be used for fatigue management of the BHA. As described herein, the term "fatigue calculator" is used to describe tracking the amount of fatigue damage that occurs in relation to the expected total life of a tool component. It is noted that the weakest points of various tools and tool components may not necessarily be a main tubular section (e.g., of a collar), but rather features that cause stress concentrations, such as threaded connections, port holes, and so forth. As described herein, drilling applications are provided by way of example and are not meant to limit the present disclosure. In other embodiments, systems, techniques, and apparatus as described herein can be used with other down hole operations. Further, such systems, techniques, and apparatus can be used in other applications not necessarily related to down hole operations.

FIG. 1 depicts a wellsite system 100 in accordance with one or more embodiments of the present disclosure. The wellsite can be onshore or offshore. A borehole 102 is formed in subsurface formations by directional drilling. A drill string 104 extends from a drill rig 106 and is suspended within the borehole 102. In some embodiments, the wellsite system 100 implements directional drilling using a rotary steerable system (RSS). For instance, the drill string 104 is rotated from the surface, and down hole devices move the end of the drill string 104 in a desired direction. The drill rig 106 includes a platform and derrick assembly positioned over the borehole 102. In some embodiments, the drill rig 106 includes a rotary table 108, kelly 110, hook 112, rotary swivel 114, and so forth. For example, the drill string 104 is rotated by the rotary table 108, which engages the kelly 110 at the upper end of the drill string 104. The drill string 104 is suspended from the hook 112 using the rotary swivel 114, which permits rotation of the drill string 104 relative to the hook 112. However, this configuration is provided by way of example and is not meant to limit the present disclosure. For instance, in other embodiments a top drive system is used.

A bottom hole assembly (BHA) 116 is suspended at the end of the drill string 104. The bottom hole assembly 116 includes a drill bit 118 at its lower end. In embodiments of the disclosure, the drill string 104 includes a number of drill pipes 120 that extend the bottom hole assembly 116 and the drill bit 118 into subterranean formations. Drilling fluid (e.g., mud) 122 is stored in a tank and/or a pit 124 formed at the wellsite. The drilling fluid 122 can be water-based, oil-based, and so on. A pump 126 displaces the drilling fluid 122 to an interior passage of the drill string 104 via, for example, a port in the rotary swivel 114, causing the drilling fluid 122 to flow downwardly through the drill string 104 as indicated by directional arrow 128. The drilling fluid 122 exits the drill string 104 via ports (e.g., courses, nozzles) in the drill bit 118, and then circulates upwardly through the annulus region between the outside of the drill string 104 and the wall of the borehole 102, as indicated by directional arrows 130. In this manner, the drilling fluid 122 cools and lubricates the drill bit 118 and carries drill cuttings generated by the drill bit 118 up to the surface (e.g., as the drilling fluid 122 is returned to the pit 124 for recirculation). Further, destabilization of the rock in the wellbore can be at least partially prevented, the pressure of fluids inside the rock can be at least partially overcome so that the fluids do not enter the wellbore, and so forth.

In embodiments of the disclosure, the drill bit 118 comprises one or more crushing and/or cutting implements, such as conical cutters and/or bit cones having spiked teeth (e.g., in the manner of a roller-cone bit). In this configuration, as the drill string 104 is rotated, the bit cones roll along the bottom of the borehole 102 in a circular motion. As they roll, new teeth come in contact with the bottom of the borehole 102, crushing the rock immediately below and around the bit tooth. As the cone continues to roll, the tooth then lifts off the bottom of the hole and a high-velocity drilling fluid jet strikes the crushed rock chips to remove them from the bottom of the borehole 102 and up the annulus. As this occurs, another tooth makes contact with the bottom of the borehole 102 and creates new rock chips. In this manner, the process of chipping the rock and removing the small rock chips with the fluid jets is continuous. The teeth intermesh on the cones, which helps clean the cones and enables larger teeth to be used. A drill bit 118 comprising a conical cutter can be implemented as a steel milled-tooth bit, a carbide insert bit, and so forth. However, roller-cone bits are provided by way of example and are not meant to limit the present disclosure. In other embodiments, a drill bit 118 is arranged differently. For example, the body of the drill bit 118 comprises one or more polycrystalline diamond compact (PDC) cutters that shear rock with a continuous scraping motion.

In some embodiments, the bottom hole assembly 116 includes a logging-while-drilling (LWD) module 132, a measuring-while-drilling (MWD) module 134, a rotary steerable system 136, a motor, and so forth (e.g., in addition to the drill bit 118). The logging-while-drilling module 132 can be housed in a drill collar and can contain one or a number of logging tools. It should also be noted that more than one LWD module and/or MWD module can be employed (e.g. as represented by another logging-while-drilling module 138). In embodiments of the disclosure, the logging-while drilling modules 132 and/or 138 include capabilities for measuring, processing, and storing information, as well as for communicating with surface equipment, and so forth.

The measuring-while-drilling module 134 can also be housed in a drill collar, and can contain one or more devices for measuring characteristics of the drill string 104 and drill bit 118. The measuring-while-drilling module 134 can also include components for generating electrical power for the down hole equipment. This can include a mud turbine generator powered by the flow of the drilling fluid 122. However, this configuration is provided by way of example and is not meant to limit the present disclosure. In other embodiments, other power and/or battery systems can be employed. The measuring-while-drilling module 134 can include one or more of the following measuring devices: a direction measuring device, an inclination measuring device, and so on. Further, a logging-while-drilling module 132 and/or 138 can include one or more measuring devices, such as a weight-on-bit measuring device, a torque measuring device, a vibration measuring device, a shock measuring device, a stick slip measuring device, and so forth.

In some embodiments, the wellsite system 100 is used with controlled steering or directional drilling. For example, the rotary steerable system 136 is used for directional drilling. As used herein, the term "directional drilling" describes intentional deviation of the wellbore from the path it would naturally take. Thus, directional drilling refers to steering the drill string 104 so that it travels in a desired direction. In some embodiments, directional drilling is used for offshore drilling (e.g., where multiple wells are drilled from a single platform). In other embodiments, directional drilling enables horizontal drilling through a reservoir, which enables a longer length of the wellbore to traverse the reservoir, increasing the production rate from the well. Further, directional drilling may be used in vertical drilling operations. For example, the drill bit 118 may veer off of a planned drilling trajectory because of the unpredictable nature of the formations being penetrated or the varying forces that the drill bit 118 experiences. When such deviation occurs, the wellsite system 100 may be used to guide the drill bit 118 back on course.

The drill string 104 can include one or more extendable displacement mechanisms, such as a piston mechanism that can be selectively actuated by an actuator to displace a pad toward, for instance, a borehole wall to cause the bottom hole assembly 116 to move in a desired direction of deviation. In embodiments of the disclosure, a displacement mechanism can be actuated by the drilling fluid 122 routed through the drill string 104. For example, the drilling fluid 122 is used to move a piston, which changes the orientation of the drill bit 118 (e.g., changing the drilling axis orientation with respect to a longitudinal axis of the bottom hole assembly 116). The displacement mechanism may be employed to control a directional bias and/or an axial orientation of the bottom hole assembly 116. Displacement mechanisms may be arranged, for example, to point the drill bit 118 and/or to push the drill bit 118. In some embodiments, a displacement mechanism is deployed by a drilling system using a rotary steerable system 136 that rotates with a number of displacement mechanisms. It should be noted that the rotary steerable system 136 can be used in conjunction with stabilizers, such as non-rotating stabilizers, and so on.

In some embodiments, a displacement mechanism can be positioned proximate to the drill bit 118. However, in other embodiments, a displacement mechanism can be positioned at various locations along a drill string, a bottom hole assembly, and so forth. For example, in some embodiments, a displacement mechanism is positioned in a rotary steerable system 136, while in other embodiments, a displacement mechanism can be positioned at or near the end of the bottom hole assembly 116 (e.g., proximate to the drill bit 118). In some embodiments, the drill string 104 can include one or more filters that filter the drilling fluid 122 (e.g., upstream of the displacement mechanism with respect to the flow of the drilling fluid 122).

Figure 2:
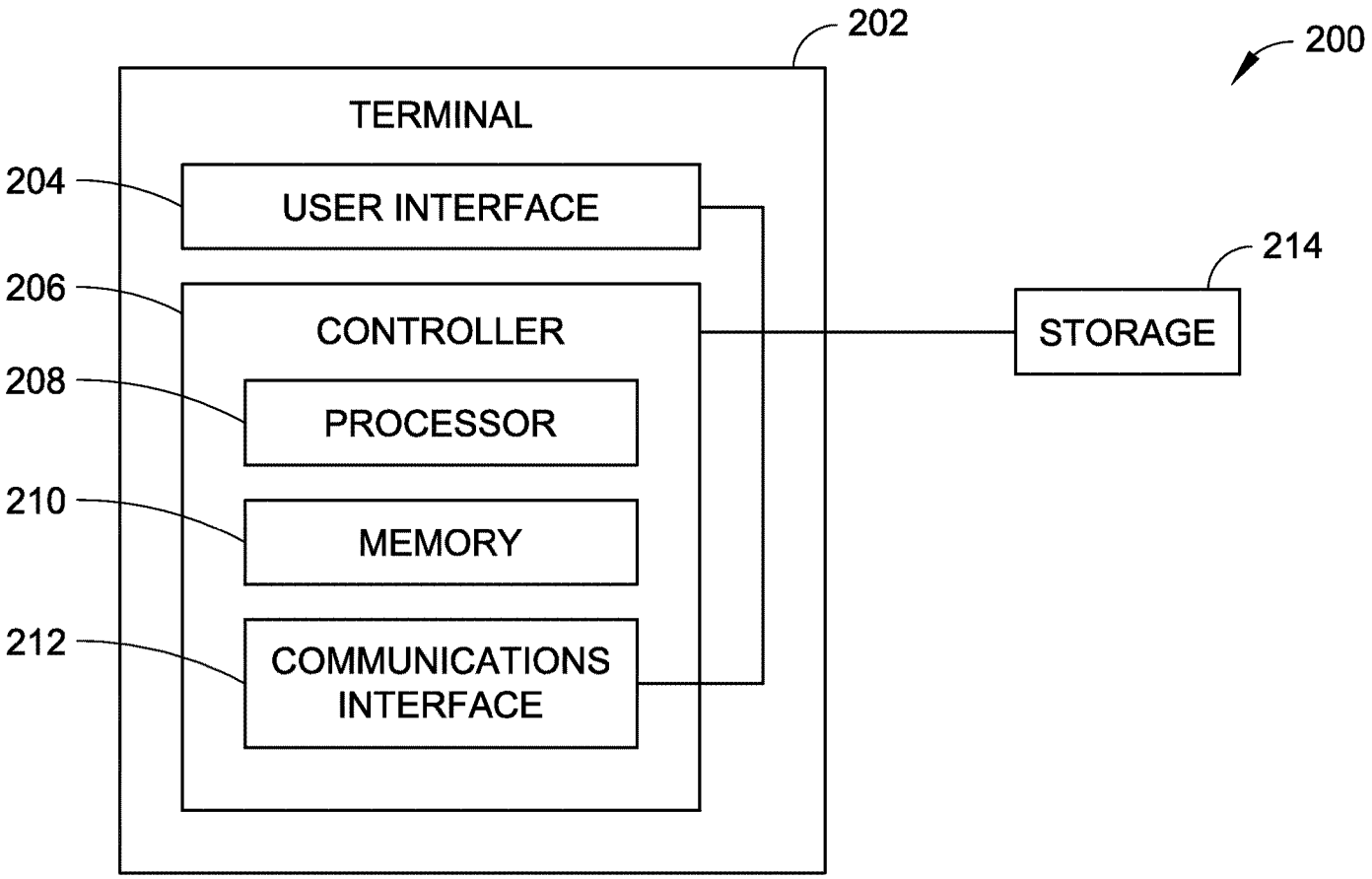
FIG. 2 illustrates an example system for fatigue calculator generation.
Figure 3:
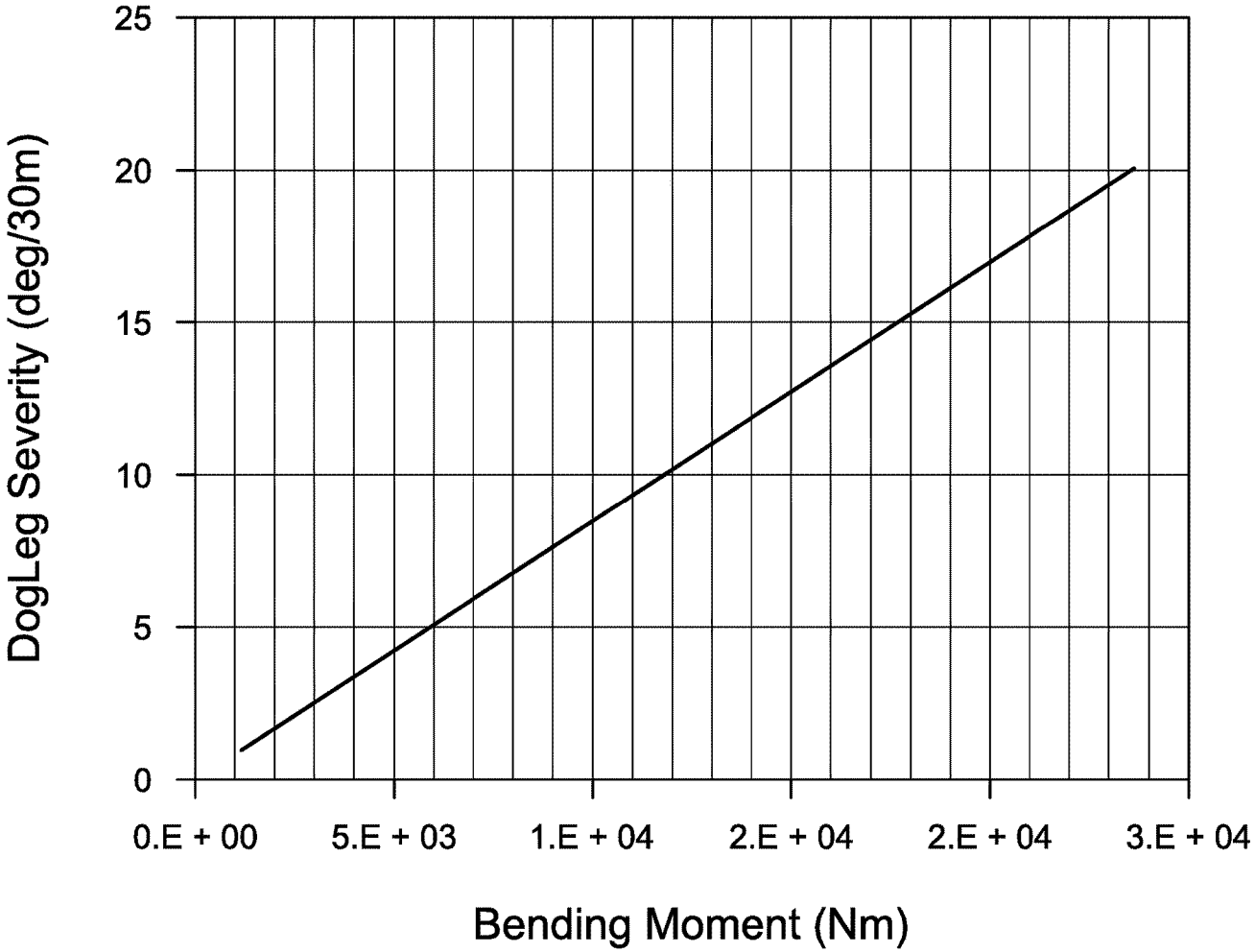
FIG. 3 is a chart that plots dog-leg severity versus bending moment for a tool.
Figure 4:
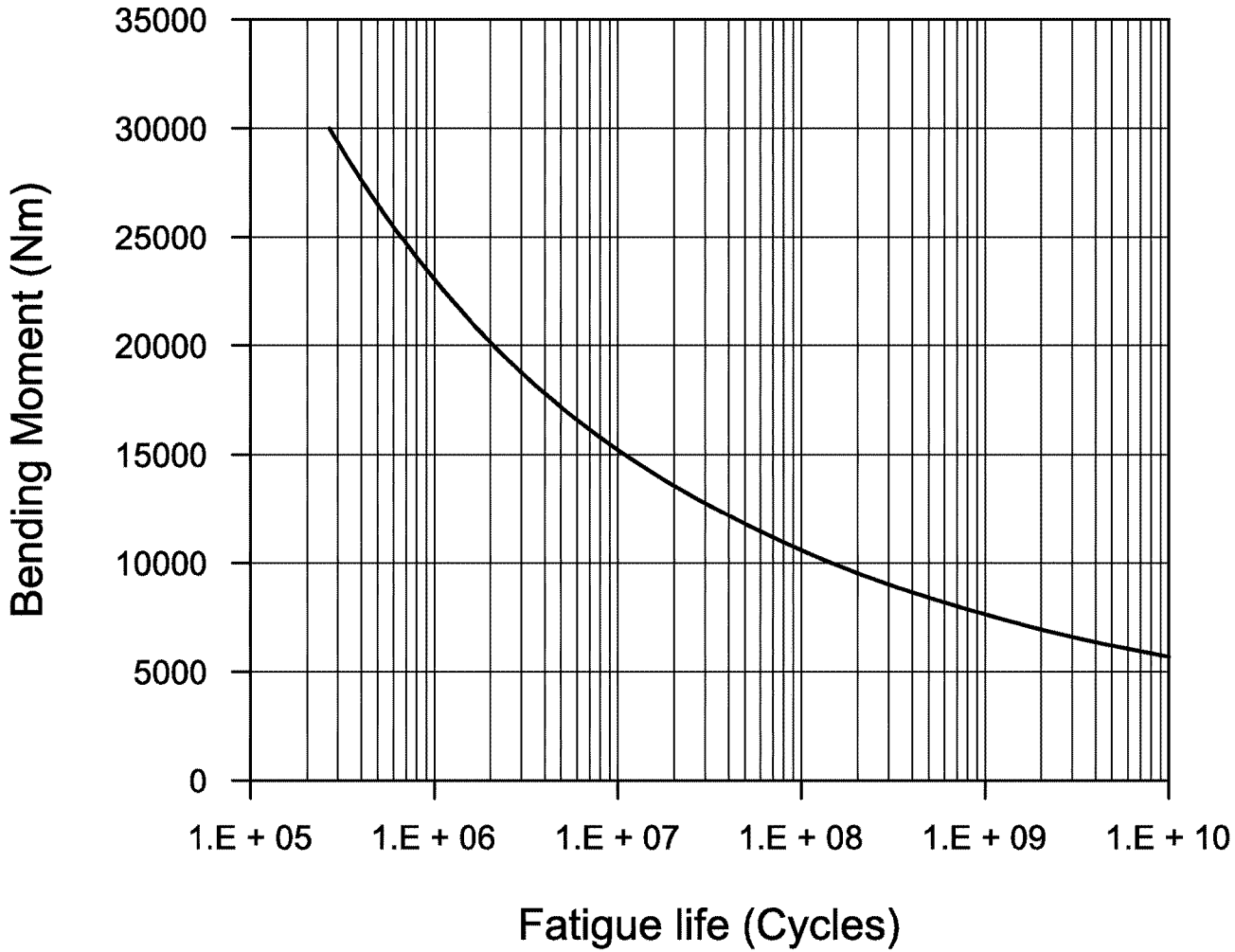
FIG. 4 is a chart that plots bending moment versus fatigue life for a tool.

Referring now to FIG. 2, example systems and devices are described that can determine fatigue for a tool, such as a BHA. A system 200 includes a control module (e.g., a terminal 202) with a user interface 204 for presenting fatigue calculators for a specified BHA configuration, fatigue damage that has occurred in relation to the expected total life of a tool component, and so on. In embodiments, the user interface 204 can be presented to an operator of the monitored equipment. For instance, the user interface 204 can be located at, for example, a drill rig. However, in other embodiments, a user interface 204 can be at a remote location. For instance, the user interface 204 can be implemented in a system that hosts software and/or associated data in the cloud. The software can be accessed by a client device (e.g., a mobile device) with a thin client (e.g., via a web browser). The operator can identify one or more fatigue susceptible features and/or generate fatigue calculators in order to take a corrective action, such as halting the drilling process, changing a drilling parameter, replacing the component having the fatigue susceptible feature, repairing the fatigue susceptible feature, and so on. For example, fatigue analysis may lead to design changes of a BHA.

The user interface 204 can be coupled to a controller 206, which can operate to present fatigue susceptible features, interactive fatigue calculators, and so forth at the user interface 204. In some embodiments, the controller 206 can determine fatigue susceptible features and/or generate fatigue calculators using estimated drilling conditions and/or real-time measurements, such as, for example, measurements transmitted from the BHA and/or sensors associated with a logging-while-drilling module 132/138, a measuring-while-drilling module 134, a rotary steerable system 136, a drill bit 118, a motor, and so forth (e.g., as described with reference to FIG. 1). For example, one or more sensors can be coupled with the controller 206 and can communicate sensed values associated with the drill string 104 to the controller 206. Information from the various sensors, as well as information about specified BHA configurations and so on may be stored locally by the controller 206 and/or in additional storage 214, which can be located remotely from the terminal (e.g., hosted in the cloud). For example, storage 214 can implement a centralized collection of data as a stable database (e.g., without replication).

In embodiments of the disclosure, the controller 206 may determine one or more fatigue susceptible features and/or generate fatigue calculators before drilling commences using information regarding the BHA, such as the material composition of BHA components, positions and locations of components and fatigue susceptible features of the BHA, spatial relationships between fatigue susceptible features, known and/or measured fatigue damage, stress and/or strain histories of drill collars and/or other components of the BHA, and so forth. In addition, loading conditions can be estimated using information from a drilling plan, such as trajectory, dog-leg severity, revolutions per minute (RPM), and so on. Then, during drilling, the controller 206 may use real-time data to update and/or re-calculate the estimated fatigue damage of each of the fatigue susceptible features of the BHA. The actual conditions encountered during drilling by each of the fatigue susceptible features of the BHA may differ from the estimated conditions provided by the well plan, and continuous updating of the fatigue damage using the real-time data may provide accurate values for the fatigue damage as drilling proceeds. For instance, fatigue tracking can be implemented to create DLS versus bending moment relationships in real-time with actual trajectories for accurate bending moments.

In some embodiments, the controller 206 may use cumulative fatigue damage to provide prognostic and/or diagnostic information with well survey and/or drilling data to monitor fatigue damage of critical components of the BHA. For example, the controller 206 may implement real-time tracking of fatigue damage of fatigue susceptible features of the BHA based on input from real-time data, such as, for example, drilling conditions and/or the bending moment-fatigue life relations intrinsic to the fatigue susceptible features. In addition, drilling operations may be adjusted to control fatigue life in response to real-time data. For example, dog-leg severity, weight on bit, torque on bit, pressure, revolutions per minute, and so forth may be adjusted based on current cumulative fatigue damage of one or more fatigue susceptible features of the BHA.

As described herein, systems and techniques in accordance with the present disclosure may be used to design components of a BHA for specified long-life applications and/or to perform pre-job planning to ensure that the BHA can complete the planned operations. For example, changes in materials and/or features of components of the BHA and/or the sequence in which components are ordered in the BHA may be performed prior to use of the BHA to improve fatigue life. Accordingly, pre-job planning and prognosis of fatigue life can be based on estimated job parameters to configure the BHA in light of fatigue damage. In this manner, the capabilities of the BHA may be maintained at a higher level and/or for a longer time under the expected job conditions (e.g., relative to a BHA that has not been analyzed in this manner). In addition, the systems and techniques described herein can enable planning of drilling operations and monitoring of cumulative fatigue damage of BHA components. Thus, drilling operations can be planned and/or adjusted so that the fatigue initiation life is not consumed by each of the fatigue susceptible features of the BHA, such as, for example, radii, portholes, and/or threaded connections of drill collars.

In some embodiments, as fatigue damage of the BHA and/or a component of the BHA increases, one or more corrective actions may be taken. The controller 206 may automatically implement the corrective action and/or the corrective action may be based on user input to the terminal 202. The corrective action may be based on information, such as, for example, the real-time data, obtained by sensors and/or transmitted to the terminal 202. The corrective action may be an adjustment of drilling operations. For example, the corrective action may be an adjustment of dog-leg severity, weight on bit, torque on bit, pressure, revolutions per minute, and so on.

The corrective action may be to interrupt the drilling, use a different BHA for the reminder of the job, re-machine the BHA for a future job, and so forth. Re-machining the BHA may involve, for example, performing a recut and/or adding compressive residual stresses that mitigate fatigue damage. The compressive residual stresses may be added by shot peening, roller burnishing, and so on. For example, if the cumulative fatigue damage approaches and/or reaches unity, a recut may be performed on one or more of the fatigue susceptible features before a dominant crack develops. The recut may remove persistent slipping bands near the surface of the fatigue susceptible feature to provide a new surface to experience fatigue excursions. The fatigue life of the BHA can be extended by monitoring the damage history of fatigue susceptible features and performing recuts on the fatigue susceptible features.

In some embodiments, the terminal 202 can compute the fatigue damage for each of the fatigue susceptible features based on user inputs and/or sensor inputs, and the terminal 202 may store, accumulate, display, arrange, and/or organize damage results. For example, the user interface 204 may be used for data entry, data display, file operations, and so on. The user interface can display fatigue damage for each of the fatigue susceptible features and/or job information. The BHA may be configured by a user of the terminal 202, and the user may provide information used by the terminal 202, such as, for example, component names, component dimensions, serial number, damage histories, and so forth. In some embodiments, survey results and/or drilling parameters may be entered using the user interface 204. Further, the damage history of one or more components of a BHA may be tracked with an identifier associated with each component, such as, for example, a serial number.

Moreover, fatigue damage may be monitored for a BHA and/or a BHA component in a borehole such that the fatigue damage for the BHA and/or the component from the previous use in the first borehole is the starting point for the fatigue damage of the BHA and/or the component for use in a subsequent borehole. For example, a selected drill collar may incur forty percent (40%) fatigue damage during use in a first borehole. Subsequently, the drill collar may be used in a second borehole, and the terminal 202 may use the forty percent (40%) fatigue damage as the starting point for monitoring fatigue damage of the selected drill collar during use in the second borehole.

In some embodiments, the system 200 can also include an alert module. The alert module can be configured to provide an alert to an operator when a condition (or set of conditions) is met for monitored equipment. For example, an alert is generated when a corrective action, such as halting the drilling process, changing a drilling parameter, replacing the component having the fatigue susceptible feature, repairing the fatigue susceptible feature, and so on is indicated. In some embodiments, an alert is provided to an operator in the form of an audible and/or visual alarm. However, these alerts are provided by way of example and are not meant to limit the present disclosure. In other embodiments, different alerts are provided to an operator. For instance, an alert can be provided to an operator in the form of an email message, a text message, and so forth. Further, multiple alerts can be provided to an operator when a condition is met for the monitored equipment (e.g., an email message and a text message, and so forth).

In some embodiments, a determination performed by a fatigue calculator includes two or more parts. First, there is a relationship between the DLS of the wellbore and the bending moment that each component has been subjected to. This relationship can be calculated from analysis performed using a beam-type finite element modeling program, which can create a mathematical description of the mass and stiffness distribution of the BHA. The second relationship is between the bending moment of each individual connection and the expected fatigue life of that component. This relationship can use both material fatigue testing to quantify fatigue properties and FEA to model a particular geometry of the feature. Example relationships are described with reference to FIGS. 3 and 4. As shown, these relationships can be used to determine a number of cycles (e.g., revolutions) that a component may experience before the component is expected to fail at each DLS.

Figure 5:
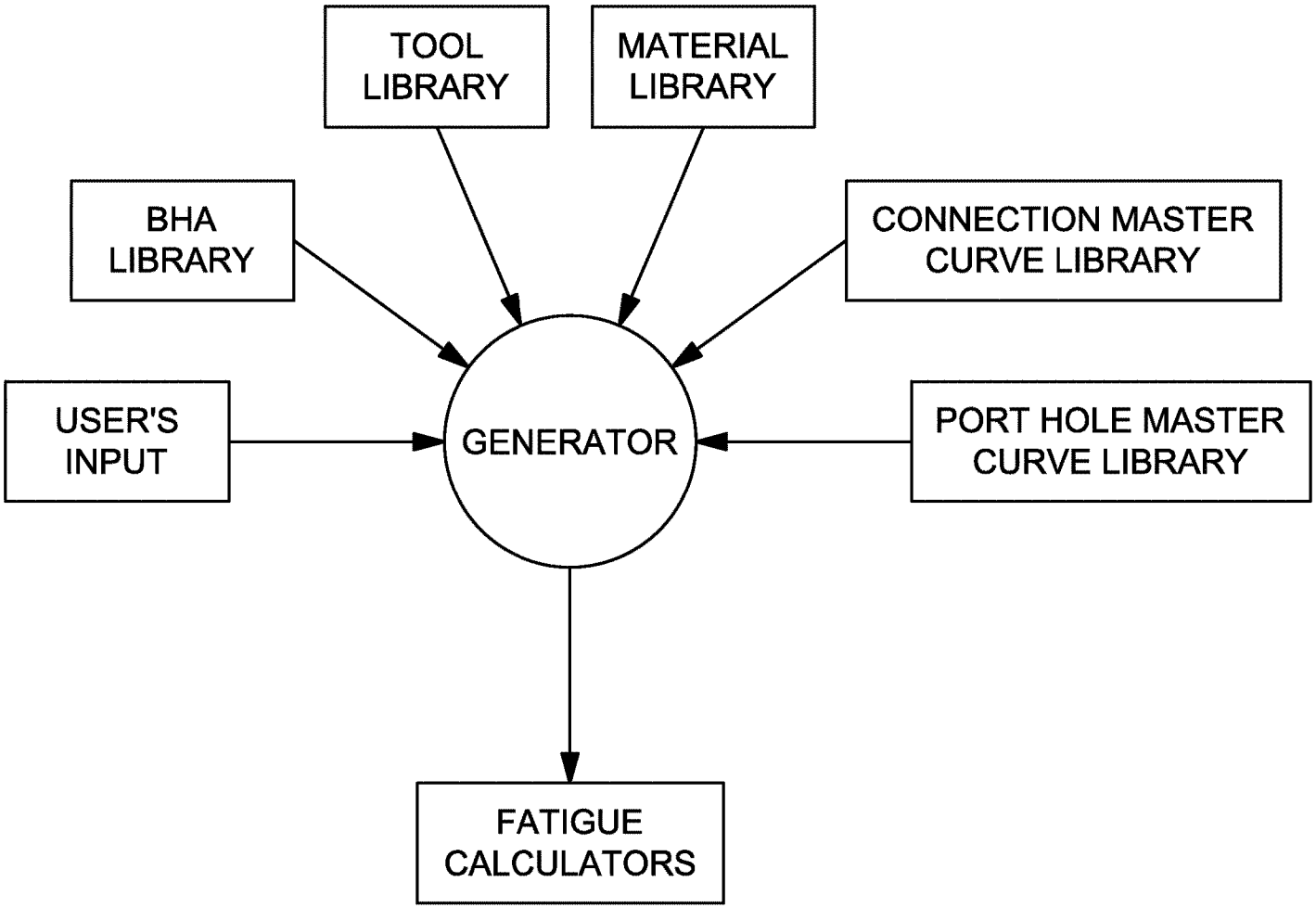
FIG. 5 illustrates an example schematic architecture for a fatigue calculator generator in accordance with one or more embodiments.
Figure 6:
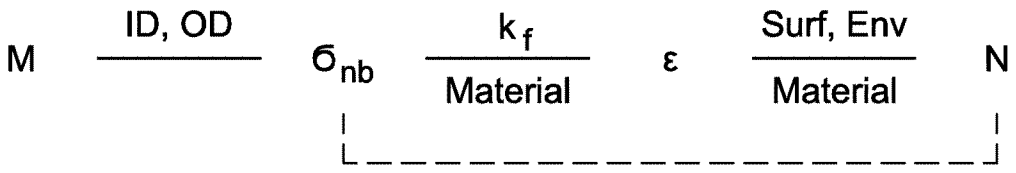
FIG. 6 illustrates a master curve relationship for a fatigue calculator generator in accordance with one or more embodiments.
Figure 7:
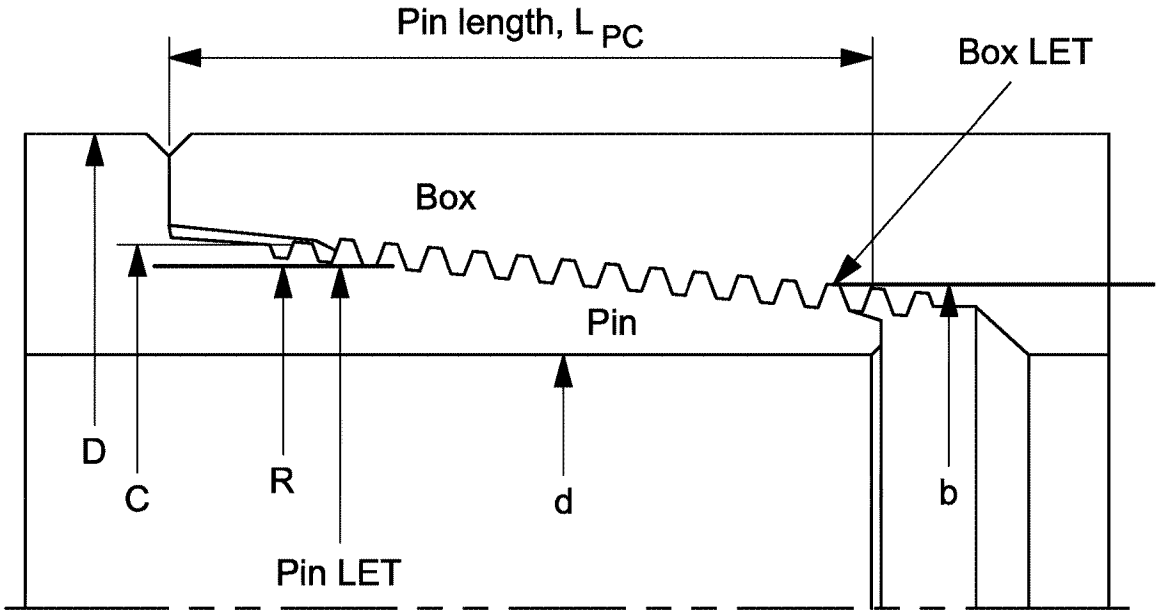
FIG. 7 illustrates last engaged threads for a threaded connection.

Referring now to FIG. 5, a schematic architecture of a fatigue calculator generator (FCG) is described. User inputs can include BHA design and drilling parameters. Other inputs to the FCG can include a BHA library, a tool library, a material library, fatigue master curves (e.g., for threaded connections and/or port holes), and so on. Respective tool libraries for tools or subs can be created, including libraries for bits, LWD/MWD tools, cross-overs, stabilizers, reamers, heavy weight drill pipe (HWDP), non-magnetic drill collars (NMDC), and so on. Outside diameter (OD) and/or inside diameter (ID) transitions can be captured with their respective section lengths for each collar and crossover. Equivalent bending stiffness can be calculated for fatigue-sensitive features, including, but not necessarily limited to: antenna section, gamma-ray section, stabilizers (sleeve type and/or integral), other sensor sections, wear band features, sections with port holes, other features, and so forth.

The BHA library can store generated BHA configurations, including related tool, material, and/or fatigue data for a current application and/or for future reference. The material library can include data for one or more collar materials (e.g., per a collar material specification), which can be specified at one or more temperatures (e.g., at room temperature, elevated temperatures, and so forth). It can include one or more material characteristics, such as, but not necessarily limited to: modulus of elasticity, Poisson's ratio, yield strength, ultimate tensile strength, elongation, reduction in area, fatigue strength parameters, and so on. The connection master curve library can include bending moment (M) versus fatigue life (N) curves to track the fatigue damage of a collar feature, including a thread groove, a port hole, a fillet radius at a diameter change, and so on. In some embodiments, fatigue life may be predicted with the following equation (Equation (1)), where $N_f$ is a number of cycles, $\sigma'_f$ is a fatigue strength coefficient, b is a fatigue strength exponent, $\varepsilon'_f$ denotes a fatigue ductility coefficient, c is a fatigue ductility exponent, and $\sigma_m$ is a mean stress.

$$\frac{\Delta\varepsilon}{2} = \frac{\sigma'_f - \sigma_m}{E}(2N_f)^b + \varepsilon'_f(2N_f)^c \tag{1}$$

In this example, fatigue life can be obtained once the alternating strain is determined (e.g., numerically and/or experimentally). The strain-life relation may depend on material properties, surface conditions, and environmental conditions. In some embodiments, numerical prediction of strain at a fatigue-sensitive collar feature can be achieved by elasto-plastic FEA of a collar section (with ID and OD) that contains the feature, which is subjected to bending moment M. Linking the two relations M–ε and ε–N can yield the ultimately targeted M–N relation. Since the same feature may be contained in a collar section with different IDs and ODs, computing an M–N curve with nonlinear FEA for each set of ID and OD may be cumbersome and time consuming. Accordingly, a master relation can be established, which is at least substantially independent of ID and OD. For instance, a quantity referred to as nominal bending stress ($\sigma_{nb}$) at a fatigue-sensitive feature (i.e., without taking into account stress concentration at the feature) is introduced that is related to fatigue life N. The $\sigma_{nb}$–ε relation can be dependent on stress concentration factor ($k_f$) and material properties. When the same geometry is used, along with the same material and same surface and environmental conditions, the $\sigma_{nb}$–ε relation can be intrinsic, independent of ID and OD of the collar section. Relationships between the quantities M, $\sigma_{nb}$, ε, and N are graphically illustrated in FIG. 6. In embodiments of the disclosure, the M–N relation determined for one fatigue-sensitive feature with FEA can be applied to the same feature contained in a collar section with a different set of ID and OD. However, it should be noted that Equation (1) is provided by way of example and is not meant to limit the present disclosure. In other embodiments, one or more equations can be used for other fatigue damage predictions, including, but not necessarily limited to: strain-life, stress-life, energy-life, and so forth.

When multiple threaded connections of the same type, but with different ODs and IDs are involved, their bending moment versus fatigue life curves are generated separately with conventional approaches (i.e., determining M–N for each connection with FEA). A closer examination of the threaded connection reveals that a more fundamental curve can be derived for the same type of connection but with different IDs and ODs. For example, a rotary shouldered connection can fail by fatigue at the last engaged thread (LET) root in the pin or in the box (e.g., as described with reference to FIG. 7). The LET root in the pin is first loaded with a mean stress induced by makeup torque. It may then be subjected to cyclic bending as the BHA undergoes revolutions in a curved well section. The LET root in the box experiences a different stress state, with a comparatively larger alternating stress but a comparatively small mean stress. Since makeup torque is determined based on the average mean stress at the LET of the pin, the mean stress in Equation (1) can be a constant (e.g., provided that a standard makeup torque is used for the same type of connection). Fatigue life of the pin, N, can then be dependent on the strain applied, which in turn can be related to $\sigma_{nb}$. Fatigue life of the box may be determined using the same approach (e.g., where mean stress at its LET root is comparatively small). As a result, the $\sigma_{nb}$–ε relation numerically determined for one connection with one set of ID and OD can be applied to other connections of the same type but with different IDs and ODs.

In embodiments of the disclosure, a threaded connection master curve can be generated as follows:

1) The fatigue life is predicted for a fixed, large bending moment, which is applied in a fixed number (e.g., 20) of equal increments by running elasto-plastic FEA, and then by using a strain-life approach.

2) The LET stress is calculated at the respective LET diameters of the pin and the box using the following equation:

$$(\sigma_b)_{LET} = \frac{M * D_{LET}}{2I} \tag{2}$$

where $(\sigma_b)_{LET}$ is a bending stress at the LET of the pin or the box, M is a bending moment, $D_{LET}$ is a diameter at the pin LET or the box LET, and I is a moment of inertia based on the pin ID and box OD.

3) A relationship is established for fatigue life versus LET stress to generate master curve fitting coefficients using the following curve fitting equation:

$$Y=A\times(X-B)^C+D \tag{3}$$

where A, B, C, and D are master curve fitting coefficients, Y is the natural log of fatigue life, and X is a bending stress at the LET diameter.

4) The standard curve fitting coefficients for a fatigue calculator can be generated with a different set of box OD and pin ID and a given set of parameters:

a. The LET stress is calculated based upon the given box OD and pin ID and the applied bending moment.

b. Fatigue life is determined using the master curve fitting coefficients and the calculated LET stress from 4) a.

c. The bending moment versus fatigue life relation is obtained using the information from 4) a and 4) b.

d. A relationship is established between fatigue life and bending moment, and curve fitting coefficients are generated for a fatigue calculator using the following equation:

$$Y=b_1\times(X-b_2)^{b_3}+b_4 \tag{4}$$

where $b_1$, $b_2$, $b_3$, and $b_4$ are standard curve fitting coefficients, Y is the natural log of fatigue life, and X is a bending moment.

In embodiments of the disclosure, threaded connection master curves can be generated using a set of parameters, including, but not necessarily limited to: thread type, surface conditions, stress relief features, material, environmental conditions, and so on. A change in one or more of the parameters can then be used to initiate generation of a new set of master curve fitting coefficients.

Figure 8:
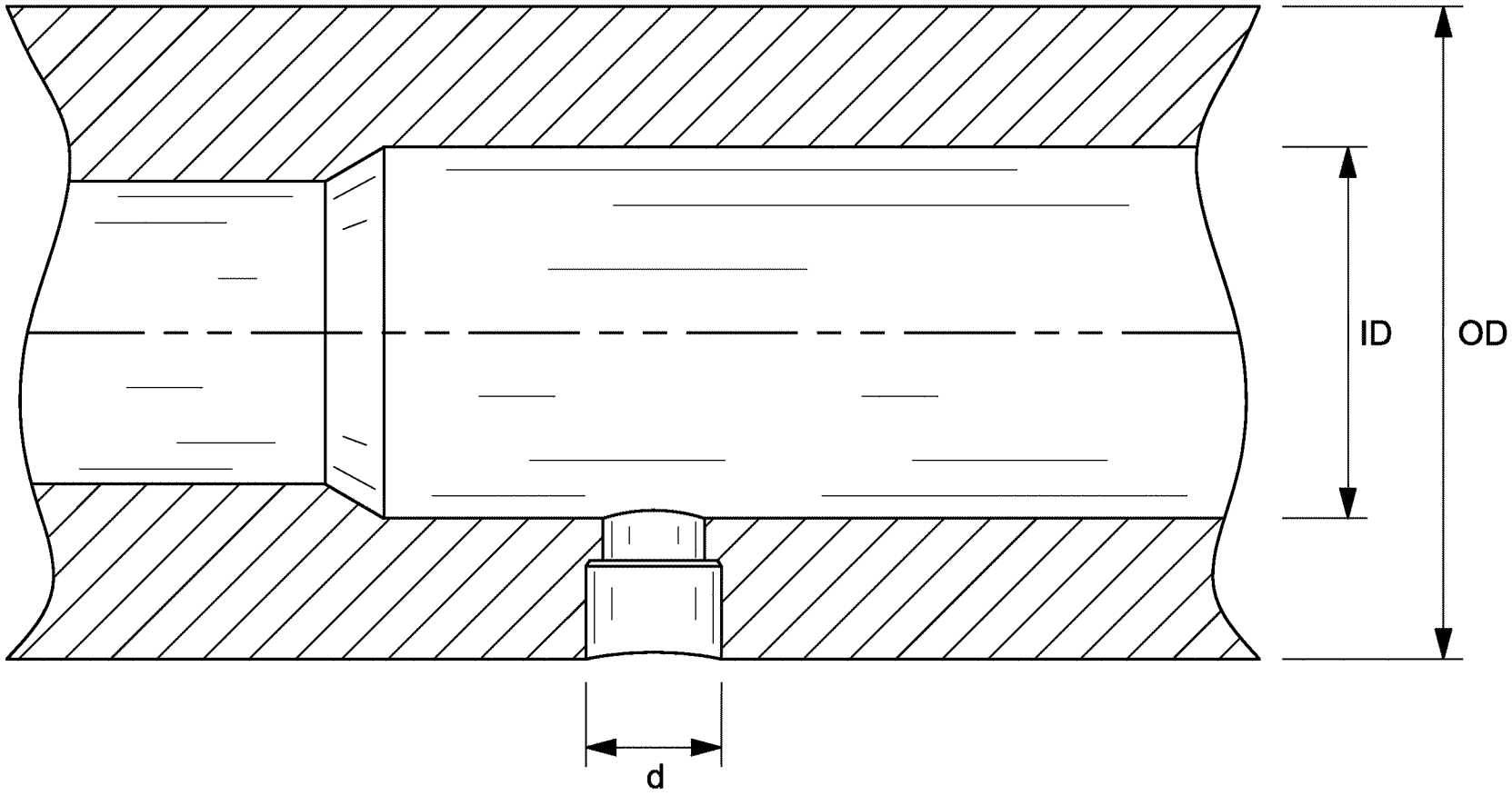
FIG. 8 illustrates dimensions of a collar section that includes a port hole.

Methodology for generating port hole master curves can be similar to that for the connection master curves previously described. Standard port hole sizes (e.g., one inch (1") in diameter and/or three-quarters of an inch (0.75") in diameter) are used in many collars of the same size (e.g., four and three-quarters of an inch (4.75") in diameter). A master curve can be established between the bending stress on the OD and the fatigue life for a collar section that contains a standard port hole (e.g., as shown in FIG. 8). In embodiments of the disclosure, a port hole master curve can be generated as follows:

1) The fatigue life is predicted as a function of the applied bending moment by performing elasto-plastic FEA, and then using a strain-life approach for the most fatigue-sensitive port hole.

2) The bending stress is calculated on collar OD using the following equation:

$$(\sigma_b)_{OD} = \frac{M * OD}{2I} \tag{5}$$

where $(\sigma_b)_{OD}$ is a bending stress on the collar OD, M is a bending moment, OD is a collar outer diameter, ID is a collar inner diameter, and I is a moment of inertia calculated with the collar OD and ID.

3) A relationship is established for fatigue life versus bending stress at collar OD to generate master curve fitting coefficients using the following curve fitting equation:

$$Y=A\times(X-B)^C+D \tag{6}$$

where A, B, C, and D are master curve fitting coefficients, Y is the natural log of fatigue life, and X is a bending stress on the collar OD.

4) The standard curve fitting coefficients for a fatigue calculator can be generated with a different set of collar OD and ID and a given set of parameters:

a. Bending stress on the collar OD is calculated based upon the given collar OD and ID and the applied bending moment.

b. Fatigue life is determined using the master curve fitting coefficients and the calculated bending stress from 4) a.

c. The bending moment versus fatigue life relation is obtained using the information from 4) a and 4) b.

d. A relationship is established between fatigue life and bending moment, and curve fitting coefficients are generated for a fatigue calculator using the following equation:

$$Y=b_1\times(X-b_2)^{b_3}+b_4 \tag{7}$$

where $b_1$, $b_2$, $b_3$, and $b_4$ are standard curve fitting coefficients, Y is the natural log of fatigue life, and X is a bending moment.

In embodiments of the disclosure, port hole master curves can be generated using a set of parameters, including, but not necessarily limited to: port hole type, surface conditions, material, environmental conditions, and so on. A change in one or more of the parameters can then be used to initiate generation of a new set of master curve fitting coefficients.

Figure 9:
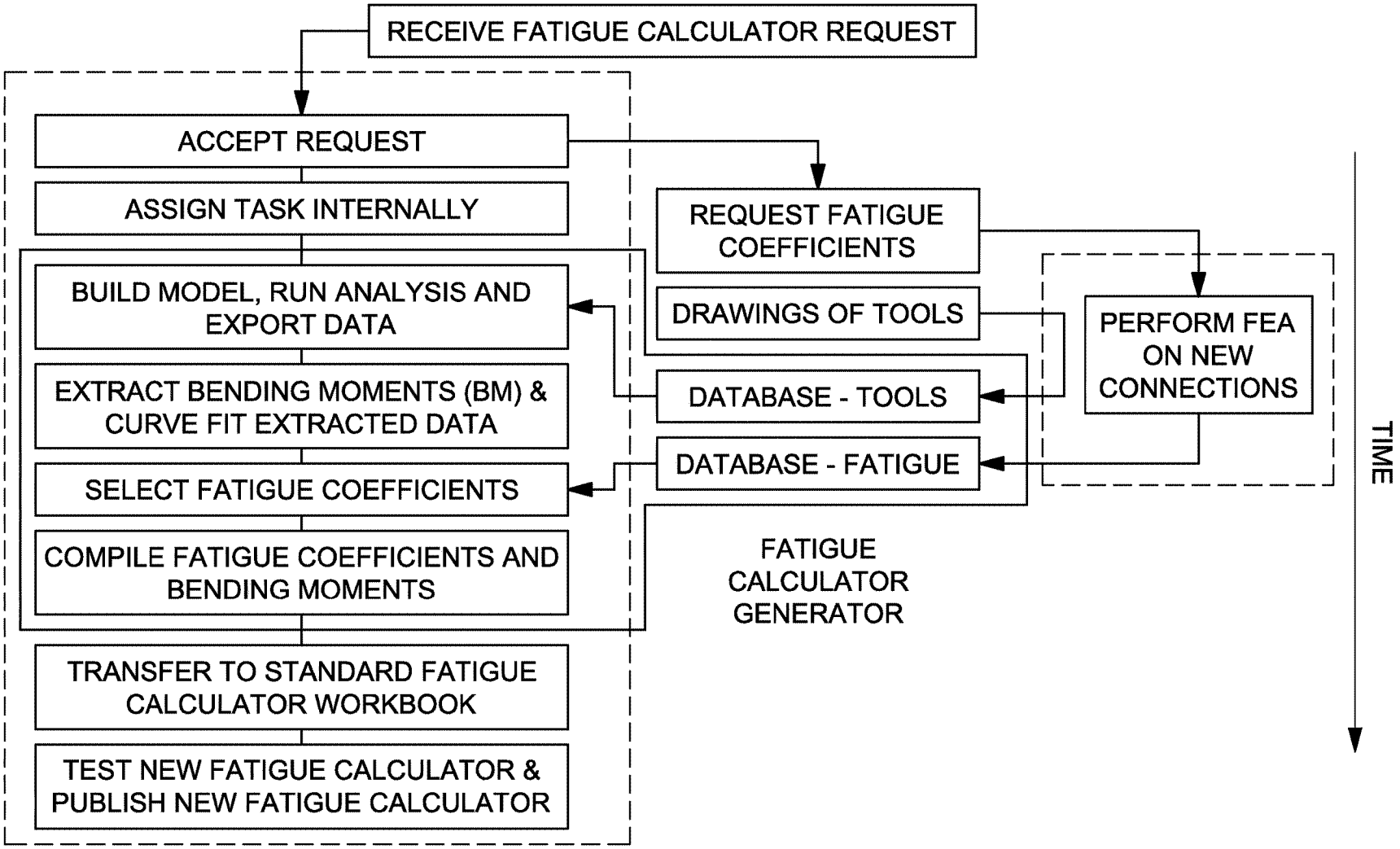
FIG. 9 illustrates a state process flow diagram for a fatigue calculator generator in accordance with one or more embodiments.

Referring now to FIG. 9, a state process flow for a fatigue calculator generator is described. The focus of this process is on steps used to produce a new fatigue calculator, which includes:

- BHA input, compiling dimensions, and exporting to a beam-based FEA program.
- Processing beam-based FEA program results files to extract relationships between bending moment and dog-leg severity for connections and/or portholes.
- Selecting fatigue curves for the connections and/or portholes.
- Compiling processed data for export to a fatigue calculator.

Figure 10:
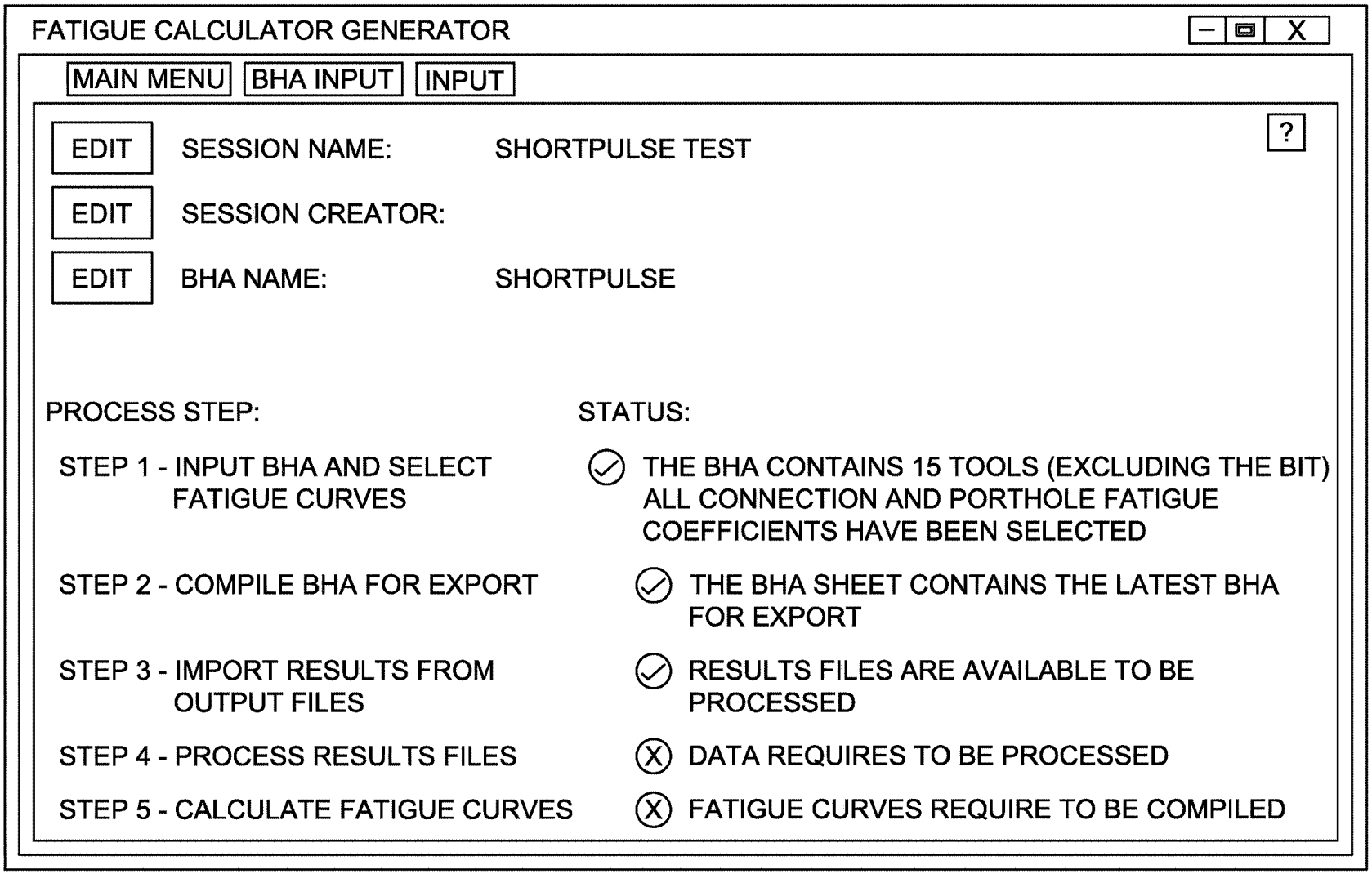
FIG. 10 illustrates a front page of a fatigue calculator generator with process step indicators in accordance with one or more embodiments.

Functions for each of the processing steps can be defined, and their interaction with one another can be structured. Architecture for a Graphical User Interface (GUI) can be defined that provides a simple and logical layout for the end user. In some embodiments, a spreadsheet application, such as Microsoft Excel, is chosen as the software used for a fatigue calculator generator. For example, a Visual Basic for Applications (VBA) programming language within a spreadsheet application can enable a fatigue calculator generator to be created easily and perform complex functions, be continuously improved from its initial release, be passed between teams, and so forth. In some embodiments, the end product, referred to herein as a fatigue calculator generator, can be a spreadsheet workbook (e.g., a Microsoft Excel workbook) with a custom GUI (e.g., as shown in FIG. 10).

As described herein, dimensions for the beam-based FEA program, and fatigue coefficients can be stored in one or more databases (e.g., the BHA library described with reference to FIG. 5) within the program. This can increase the traceability of the generated fatigue calculator (e.g., when input information is kept within one location allowing for it to be archived easily, and subsequent updates to a fatigue calculator generator do not necessarily change previously archived workbooks). As described herein, a fatigue calculator generator can guide a user through a five (5) step process to generate a new fatigue calculator, with status indicators to ensure that steps are completed in order. In some embodiments, input popup windows can be used to select BHA components and corresponding fatigue coefficients. The use of push buttons, drop down menus, filters, and so on can create a simple interface that allows a user to make quick selections of variables from the databases.

Each step of the automated processing of the data can produce a graph of the output, which can allow a user to verify the calculations. These graphs can also be exported to presentations when required. For example, comparisons of fatigue curves for connections and port holes on a BHA can allow a user to identify a weakest link on the BHA. In some embodiments, the output of the fatigue calculator generator can be a table of bending moment and fatigue coefficients that can be used to generate a new fatigue calculator. In some embodiments, one or more fatigue calculators are used to predict the fatigue life of a tool and/or one or more tool components. For example, a fatigue calculator or set of fatigue calculators is used to determine whether a specified tool, a specified tool material, a specified BHA configuration, and so on is a desired implementation for a particular job (e.g., in the case of a high dog-leg severity job). For instance, fatigue calculators can be used to generate a well plan and assist in tool selection, material selection, BHA configuration selection, and so forth. In some embodiments, one or more fatigue calculators are used to manage fatigue damage of a tool, tool component, BHA, and so forth. For example, a wellbore trajectory can be monitored while drilling, and one or more fatigue calculators can be constructed on the fly based upon the monitoring. Then, an alert can be initiated when a certain condition or set of conditions is met for a tool, tool component, BHA, and so forth (e.g., an alert indicating that a tool, a tool component, a BHA, and so on is at or near the end of its useful life).

In some embodiments, a system can make a determination regarding whether a particular set of fatigue calculator generation parameters (e.g., master curve fitting coefficients) are applicable to a particular tool or tool component configuration. For example, a set of master curve fitting coefficients can be used for connection types where a ratio of inside diameter to outside diameter is between at least approximately four-tenths (0.4) and seven-tenths (0.7). However, these ratios are provided by way of example and are not meant to limit the present disclosure. In other embodiments, master curve fitting coefficients can be used for connection types having different ratios.

As described herein, a system used to implement a fatigue calculator generator, including its components or some of its components, can operate under computer control. For example, a processor can be included with or in a system to control the components and functions of systems described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the systems. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

The system can include a processor, a memory, and a communications interface. The processor provides processing functionality for the system and can include any number of processors, micro-controllers, or other processing systems, and resident or external memory for storing data and other information accessed or generated by the system. The processor can execute one or more software programs that implement techniques described herein. The processor is not limited by the materials from which it is formed or the processing mechanisms employed therein and, as such, can be implemented via semiconductor(s) and/or transistors (e.g., using electronic integrated circuit (IC) components), and so forth.

The memory is an example of tangible, computer-readable storage medium that provides storage functionality to store various data associated with operation of the system, such as software programs and/or code segments, or other data to instruct the processor, and possibly other components of the system, to perform the functionality described herein. Thus, the memory can store data, such as a program of instructions for operating the system (including its components), and so forth. It should be noted that while a single memory is described, a wide variety of types and combinations of memory (e.g., tangible, non-transitory memory) can be employed. The memory can be integral with the processor, can comprise stand-alone memory, or can be a combination of both.

The memory can include, but is not necessarily limited to: removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the system and/or the memory can include removable integrated circuit card (ICC) memory, such as memory provided by a subscriber identity module (SIM) card, a universal subscriber identity module (USIM) card, a universal integrated circuit card (UICC), and so on.

The communications interface is operatively configured to communicate with components of the system. For example, the communications interface can be configured to transmit data for storage in the system, retrieve data from storage in the system, and so forth. The communications interface is also communicatively coupled with the processor to facilitate data transfer between components of the system and the processor (e.g., for communicating inputs to the processor received from a device communicatively coupled with the system). It should be noted that while the communications interface is described as a component of a system, one or more components of the communications interface can be implemented as external components communicatively coupled to the system via a wired and/or wireless connection. The system can also comprise and/or connect to one or more input/output (I/O) devices (e.g., via the communications interface), including, but not necessarily limited to: a display, a mouse, a touchpad, a keyboard, and so on.

The communications interface and/or the processor can be configured to communicate with a variety of different networks, including, but not necessarily limited to: a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example and is not meant to limit the present disclosure. Further, the communications interface can be configured to communicate with a single network or multiple networks across different access points.

Generally, any of the functions described herein can be implemented using hardware (e.g., fixed logic circuitry such as integrated circuits), software, firmware, manual processing, or a combination thereof. Thus, the blocks discussed in the above disclosure generally represent hardware (e.g., fixed logic circuitry such as integrated circuits), software, firmware, or a combination thereof. In the instance of a hardware configuration, the various blocks discussed in the above disclosure may be implemented as integrated circuits along with other functionality. Such integrated circuits may include the functions of a given block, system, or circuit, or a portion of the functions of the block, system, or circuit. Further, elements of the blocks, systems, or circuits may be implemented across multiple integrated circuits. Such integrated circuits may comprise various integrated circuits, including, but not necessarily limited to: a monolithic integrated circuit, a flip chip integrated circuit, a multichip module integrated circuit, and/or a mixed signal integrated circuit. In the instance of a software implementation, the various blocks discussed in the above disclosure represent executable instructions (e.g., program code) that perform specified tasks when executed on a processor. These executable instructions can be stored in one or more tangible computer readable media. In some such instances, the entire system, block, or circuit may be implemented using its software or firmware equivalent. In other instances, one part of a given system, block, or circuit may be implemented in software or firmware, while other parts are implemented in hardware.

With reference to FIG. 2, a system 200, including some or all of its components, can operate under computer control. For example, a processor can be included with or in a system 200 to control the components and functions of systems 200 described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the systems 200. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

The controller 206 can include a processor 208, a memory 210, and a communications interface 212. The processor 208 provides processing functionality for the controller 206 and can include any number of processors, micro-controllers, or other processing systems, and resident or external memory for storing data and other information accessed or generated by the controller 206. The processor 208 can execute one or more software programs that implement techniques described herein. The processor 208 is not limited by the materials from which it is formed or the processing mechanisms employed therein and, as such, can be implemented via semiconductor(s) and/or transistors (e.g., using electronic integrated circuit (IC) components), and so forth.

The memory 210 is an example of tangible, computer-readable storage medium that provides storage functionality to store various data associated with operation of the controller 206, such as software programs and/or code segments, or other data to instruct the processor 208, and possibly other components of the controller 206, to perform the functionality described herein. Thus, the memory 210 can store data, such as a program of instructions for operating the system 200 (including its components), and so forth. It should be noted that while a single memory 210 is described, a wide variety of types and combinations of memory (e.g., tangible, non-transitory memory) can be employed. The memory 210 can be integral with the processor 208, can comprise stand-alone memory, or can be a combination of both.

The memory 210 can include, but is not necessarily limited to: removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the drill rig control module 202 and/or the memory 210 can include removable integrated circuit card (ICC) memory, such as memory provided by a subscriber identity module (SIM) card, a universal subscriber identity module (USIM) card, a universal integrated circuit card (UICC), and so on.

The communications interface 212 is operatively configured to communicate with components of the system 200. For example, the communications interface 212 can be configured to transmit data for storage in the system 200, retrieve data from storage in the system 200, and so forth. The communications interface 212 is also communicatively coupled with the processor 208 to facilitate data transfer between components of the system 200 and the processor 208 (e.g., for communicating inputs to the processor 208 received from a device communicatively coupled with the controller 206, such as a sensor 208). It should be noted that while the communications interface 212 is described as a component of a controller 206, one or more components of the communications interface 212 can be implemented as external components communicatively coupled to the system 200 via a wired and/or wireless connection. The controller 206 can also comprise and/or connect to one or more input/output (I/O) devices (e.g., via the communications interface 212), including, but not necessarily limited to: a display, a mouse, a touchpad, a keyboard, and so on.

The communications interface 212 and/or the processor 208 can be configured to communicate with a variety of different networks, including, but not necessarily limited to: a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface 212 can be configured to communicate with a single network or multiple networks across different access points.

Generally, any of the functions described herein can be implemented using hardware (e.g., fixed logic circuitry such as integrated circuits), software, firmware, manual processing, or a combination thereof. Thus, the blocks discussed in the above disclosure generally represent hardware (e.g., fixed logic circuitry such as integrated circuits), software, firmware, or a combination thereof. In the instance of a hardware configuration, the various blocks discussed in the above disclosure may be implemented as integrated circuits along with other functionality. Such integrated circuits may include all of the functions of a given block, system, or circuit, or a portion of the functions of the block, system, or circuit. Further, elements of the blocks, systems, or circuits may be implemented across multiple integrated circuits. Such integrated circuits may comprise various integrated circuits, including, but not necessarily limited to: a monolithic integrated circuit, a flip chip integrated circuit, a multichip module integrated circuit, and/or a mixed signal integrated circuit. In the instance of a software implementation, the various blocks discussed in the above disclosure represent executable instructions (e.g., program code) that perform specified tasks when executed on a processor. These executable instructions can be stored in one or more tangible computer readable media. In some such instances, the entire system, block, or circuit may be implemented using its software or firmware equivalent. In other instances, one part of a given system, block, or circuit may be implemented in software or firmware, while other parts are implemented in hardware.

Although only a few example embodiments have been described in detail above, those skilled in the art will readily appreciate that many modifications are possible in the example embodiments without materially departing from fatigue calculator generation system. Features shown in individual embodiments referred to above may be used together in combinations other than those which have been shown and described specifically. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for tracking fatigue experienced by a tool in real-time, the system comprising:

a controller to receive a real-time trajectory for the tool from at least one of a user interface or a sensor coupled with the tool;

a memory operable to store one or more modules; and a processor operably coupled to the memory, the processor operable to execute the one or more modules to:

generate master curve fitting coefficients for a connection type associated with a tool component of the tool, generate a fatigue calculator for the tool component based upon the master curve fitting coefficients, determine a curvature from the trajectory of the tool, determine a bending moment based upon the curvature, determine fatigue damage for the tool component based upon the bending moment using the fatigue calculator, and take corrective action based on the determined fatigue damage for the tool component.

2. The system as recited in claim 1, wherein the master curve fitting coefficients are for a threaded connection master curve.

3. The system as recited in claim 2, wherein the master curve fitting coefficients are generated by predicting fatigue life for a fixed bending moment applied in a fixed number of increments using elasto-plastic finite element analysis and strain-life determination, determining a plurality of stresses for respective last engaged thread diameters, and establishing a relationship between fatigue life and last engaged thread stress.

4. The system as recited in claim 1, wherein the master curve fitting coefficients are for a port hole master curve.

5. The system as recited in claim 4, wherein the master curve fitting coefficients are generated by predicting fatigue life as a function of an applied bending moment using elasto-plastic finite element analysis and strain-life determination, determining a bending stress for a collar outside diameter, and establishing a relationship between fatigue life and bending stress at the collar outside diameter.

6. The system as recited in claim 1, wherein the tool component is a component of a bottom hole assembly, and wherein taking the corrective action is selected from the group consisting of interrupting a drilling process, adjusting a drilling parameter, repairing the tool component, and replacing the tool component.

7. A method for tracking fatigue experienced by a tool in real-time comprising:

generating master curve fitting coefficients for a connection type associated with a tool component of the tool;

receiving a real-time trajectory for the tool;

determining a curvature from the trajectory of the tool;

determining a bending moment based upon the curvature;

determining fatigue damage for the tool component based upon the bending moment using the master curve fitting coefficients; and taking corrective action based on the determined fatigue damage for the tool component.

8. The method as recited in claim 7, wherein the master curve fitting coefficients are for a threaded connection master curve.

9. The method as recited in claim 8, wherein generating the master curve fitting coefficients comprises predicting fatigue life for a fixed bending moment applied in a fixed number of increments using elasto-plastic finite element analysis and strain-life determination, determining a plurality of stresses for respective last engaged thread diameters, and establishing a relationship between fatigue life and last engaged thread stress.

10. The method as recited in claim 7, wherein the master curve fitting coefficients are for a port hole master curve.

11. The method as recited in claim 10, wherein generating the master curve fitting coefficients comprises predicting fatigue life as a function of an applied bending moment using elasto-plastic finite element analysis and strain-life determination, determining a bending stress for a collar outside diameter, and establishing a relationship between fatigue life and bending stress at the collar outside diameter.

12. The method as recited in claim 7, further comprising generating a fatigue calculator for the tool component.

13. The method as recited in claim 7, wherein the tool component is a component of a bottom hole assembly, and wherein taking the corrective action is selected from the group consisting of interrupting a drilling process, adjusting a drilling parameter, repairing the tool component, and replacing the tool component.

14. A system for tracking fatigue experienced by a tool, the system comprising:

a controller to receive a trajectory for the tool;

a memory operable to store one or more modules; and a processor operably coupled to the memory, the processor operable to execute the one or more modules to:

generate master curve fitting coefficients for a connection type associated with a tool component of the tool, determine a curvature from the trajectory of the tool, determine a bending moment based upon the curvature, determine fatigue damage for the tool component based upon the bending moment using the master curve fitting coefficients, and take corrective action based on the determined fatigue damage for the tool component.

15. The system as recited in claim 14, wherein the master curve fitting coefficients are for a threaded connection master curve.

16. The system as recited in claim 15, wherein the master curve fitting coefficients are generated by predicting fatigue life for a fixed bending moment applied in a fixed number of increments using elasto-plastic finite element analysis and strain-life determination, determining a plurality of stresses for respective last engaged thread diameters, and establishing a relationship between fatigue life and last engaged thread stress.

17. The system as recited in claim 14, wherein the master curve fitting coefficients are for a port hole master curve.

18. The system as recited in claim 17, wherein the master curve fitting coefficients are generated by predicting fatigue life as a function of an applied bending moment using elasto-plastic finite element analysis and strain-life determination, determining a bending stress for a collar outside diameter, and establishing a relationship between fatigue life and bending stress at the collar outside diameter.

19. The system as recited in claim 14, wherein the processor is operable to execute the one or more modules to generate a fatigue calculator for the tool component.

20. The system as recited in claim 14, wherein the tool component is a component of a bottom hole assembly, and wherein taking the corrective action is selected from the group consisting of interrupting a drilling process, adjusting a drilling parameter, repairing the tool component, and replacing the tool component.

* * * * *